US007373783B2

(12) United States Patent
Kanaya

(10) Patent No.: US 7,373,783 B2
(45) Date of Patent: May 20, 2008

(54) OUTDOOR UNIT OF AIR CONDITIONER AND CONTROLLING METHOD FOR THE SAME

(75) Inventor: Osamu Kanaya, Chiyoda-ku (JP)

(73) Assignee: Mitsubishi Denki Kabushiki Kaisha, Chiyoda-Ku, Tokyo (JP)

( * ) Notice: Subject to any disclaimer, the term of this patent is extended or adjusted under 35 U.S.C. 154(b) by 545 days.

(21) Appl. No.: 11/010,330

(22) Filed: Dec. 14, 2004

(65) Prior Publication Data

US 2005/0166611 A1 Aug. 4, 2005

(30) Foreign Application Priority Data

Feb. 4, 2004 (JP) ..... 2004-027784

(51) Int. Cl.
*G05D 23/00* (2006.01)
*F25B 49/00* (2006.01)
*F25B 7/00* (2006.01)

(52) U.S. Cl. ..... 62/132; 236/51; 62/160

(58) Field of Classification Search ..... 62/132, 62/228.1, 126, 160, 175; 236/51
See application file for complete search history.

(56) References Cited

U.S. PATENT DOCUMENTS 5,832,735 A * 11/1998 Matsumoto et al. ..... 62/151

FOREIGN PATENT DOCUMENTS

JP 9-196443 7/1997
JP 09-196443 7/1997

* cited by examiner

*Primary Examiner*—Chen-Wen Jiang
(74) *Attorney, Agent, or Firm*—Buchanan Ingersoll & Rooney PC

(57) ABSTRACT

To provide an air conditioner capable of operating devices in an outdoor unit by connecting an indoor unit, which is capable of transmitting operational commands and operational modes using simple ON/OFF signals to the outdoor unit, even if the indoor unit does not have transmission means for transmitting and receiving information between the outdoor unit, or the indoor unit has transmission means with a different data transmission protocol from the outdoor unit.

When it is determined that only ON/OFF signals of operational commands and operation modes have been transmitted, the devices disposed inside the outdoor unit are independently controlled based on the ON/OFF signals.

2 Claims, 2 Drawing Sheets

OUTDOOR UNIT OF AIR CONDITIONER AND CONTROLLING METHOD FOR THE SAME

BACKGROUND OF THE INVENTION

1. Field of the Invention

The present invention relates to an outdoor unit of an air conditioner and a method for controlling the outdoor unit, and more specifically, the invention relates to an outdoor unit that allows continuous use of an old indoor unit, for example, after the air conditioner is replaced with a new air conditioner.

2. Description of the Related Art

A known air conditioner has transmission means for transmitting operational command signals and information on the operational status between an indoor unit and an outdoor unit. Based on information from the transmission means, the known air conditioner controls a compressor, a blower of a heat exchanger, a four-way valve, and an expansion valve disposed inside the outdoor unit. Recently, air conditioners that save energy and have detailed functions are in general use. In particular, data communication protocols used between an indoor unit and an outdoor unit of inverter type air conditioners have become complex and a wide variety of data communication protocols are in use (for example, refer to Patent Document 1).

[Patent Document 1]

Japanese Unexamined Patent Application Publication No. 9-196443.

DISCLOSURE OF THE INVENTION

Problems to be Solved by the Invention

Accordingly, a known air conditioner controls a compressor, a blower of a heat exchanger, a four-way valve, and an expansion valve disposed inside an outdoor unit by transmitting operational command signals and information on the operational status between the outdoor unit and an indoor unit. For this reason, when an indoor unit not having transmission means for transmitting information, in other words, capable of only transmitting simple ON/OFF signals for operational commands and operation modes is connected to the outdoor unit, the air conditioner cannot be operated since the information required for operating the compressor, the blower of the heat exchanger, the four-way valve, and the expansion valve disposed inside the outdoor unit is not transmitted. In other words, there is a problem in that unless the indoor unit and the outdoor unit have the same data communication protocol, information cannot be transmitted between them because of different types of data communication protocols.

SUMMARY OF THE INVENTION

An object of the present invention is to provide an air conditioner enabling operation of devices included in an outdoor unit by connecting an indoor unit, which is capable of transmitting operational commands and operational modes using simple ON/OFF signals, even if the indoor unit does not have transmission means for transmitting the information or the indoor unit has transmission means with a different data transmission protocol from the outdoor unit.

Means for Solving the Problems

A method for controlling an outdoor unit of an air conditioner according to the present invention is characterized in that even when only ON/OFF signals of operational commands and operation modes have been transmitted from an indoor unit to an outdoor unit, devices disposed inside the outdoor unit are independently controlled based on the ON/OFF signals.

Effects of the Invention

In the method for controlling an outdoor unit of an air conditioner according to the present invention, when it is determined that only ON/OFF signals of operational commands and operation modes have been transmitted, the devices disposed inside the outdoor unit are independently controlled based on the ON/OFF signals. Therefore, the devices included in the outdoor unit can be operated by connecting an indoor unit, which is capable of transmitting operational commands and operational modes using simple ON/OFF signals, even if the indoor unit does not have transmission means for transmitting the information or the indoor unit has transmission means with a different data transmission protocol from the outdoor unit. In this way, an old indoor unit can be used, for example, after the air conditioner is replaced with a new air conditioner, as long as the old indoor unit is capable of transmitting operational commands and operational modes using only ON/OFF signals.

BRIEF DESCRIPTION OF THE DRAWINGS

FIG. 1 is a block diagram illustrating a controller of an outdoor unit of an air conditioner according to an embodiment of the present invention.

FIG. 2 is a refrigerant circuit of the air conditioner according to an embodiment of the present invention.

FIG. 3 is a schematic view illustrating the relationship between internal processing of indoor units of the air conditioner according to an embodiment of the present invention and the transmitted data.

FIG. 4 is a flow chart describing a method for controlling the outdoor unit of the air conditioner according to an embodiment of the present invention.

BEST MODE FOR CARRYING OUT THE INVENTION

Figure 1:
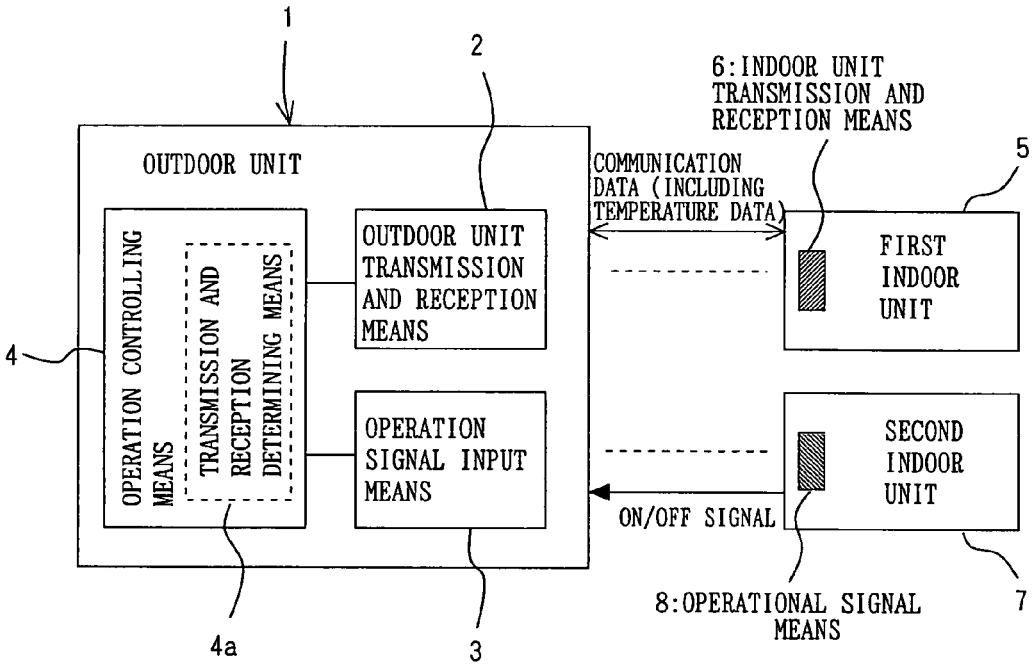
[FIG. 1]

The present invention will now be described below based on the embodiments illustrated in the drawings.

Figure 2:
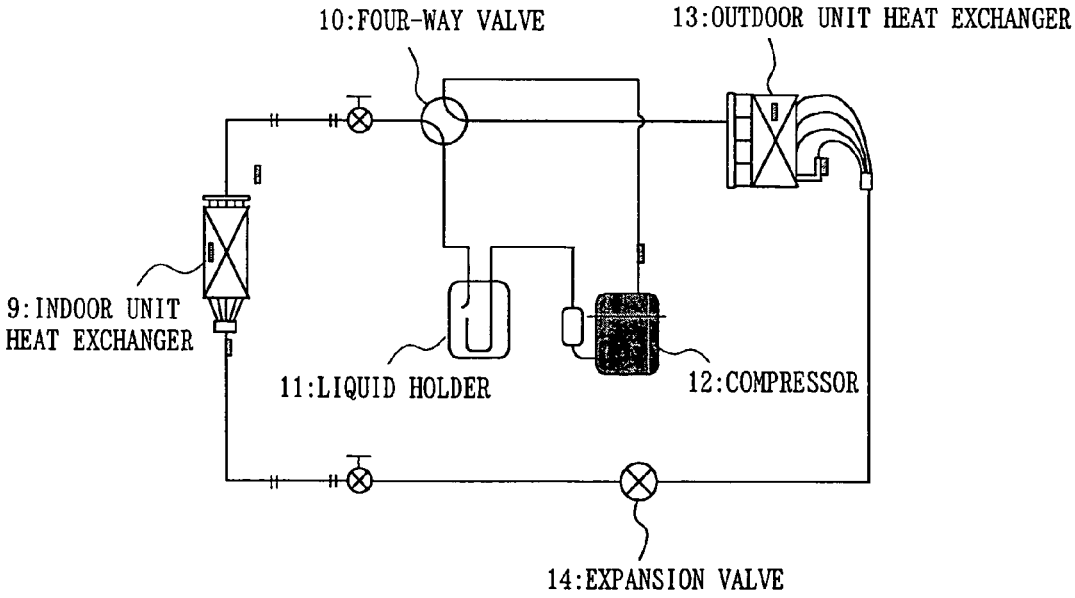
[FIG. 2]
Figure 3:
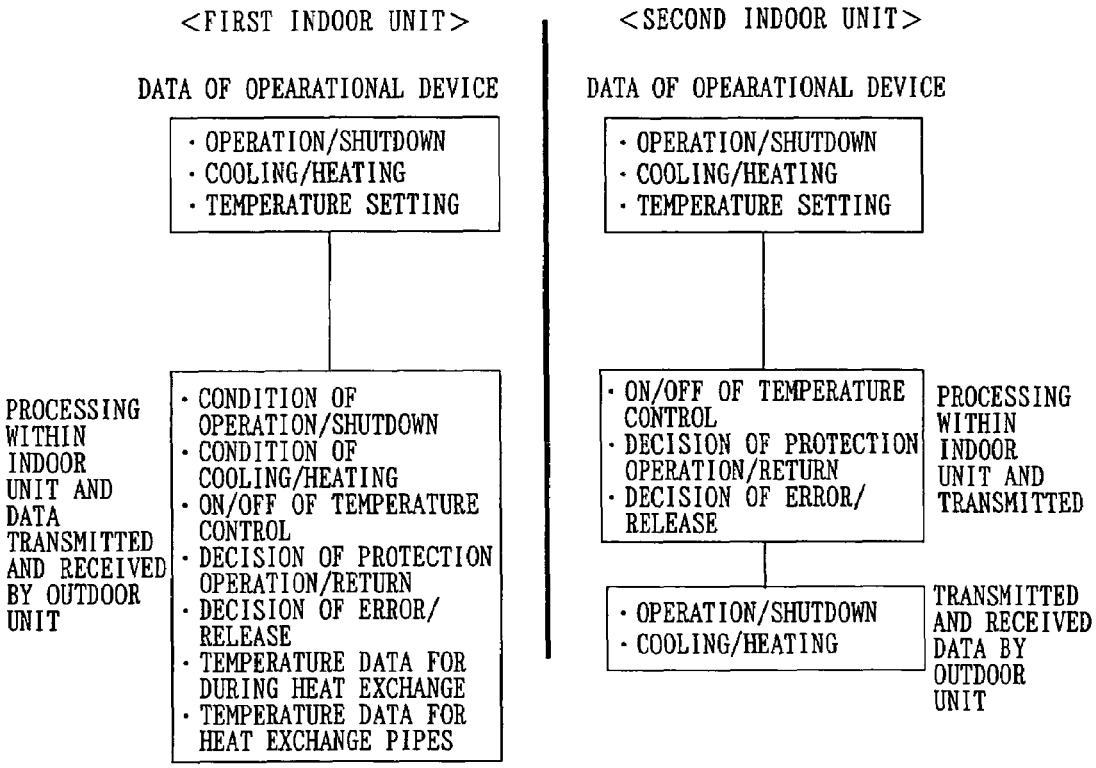
[FIG. 3]
Figure 4:
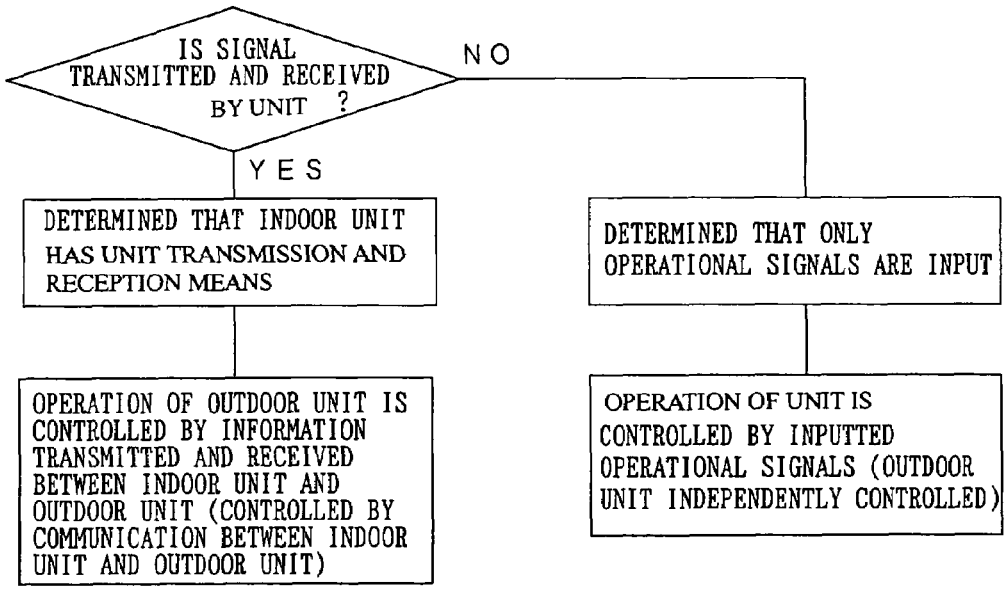
[FIG. 4]

FIG. 1 is a block diagram illustrating a controller of an outdoor unit of an air conditioner according to an embodiment of the present invention. FIG. 2 illustrates a refrigerant circuit. FIG. 3 is a schematic diagram illustrating the relationship between the internal processing of the indoor unit and the transmitted data. FIG. 4 is a flow chart describing a method for controlling the outdoor unit.

A controller of an outdoor unit of an air conditioner according to this embodiment includes outdoor unit transmission and reception means 2, operational signal input means 3, and operation controlling means 4, which are disposed inside the outdoor unit. Further, the operation controlling means 4 includes transmission and reception determining means 4*a*. On the other hand, inside an indoor unit (hereinafter referred to as a first indoor unit) 5 which is capable of transmitting and receiving signals (hereinafter referred to information signals) including signals of the operational commands, the operational modes and various data such as temperature data to and from the outdoor unit 1, indoor unit transmission and reception means 6 for transmitting and receiving the information signals including signals of the various data to and from the outdoor unit transmission and reception means 2 of the outdoor unit 1 is provided. Another indoor unit (hereinafter referred to as a second indoor unit) 7 of a different type, which does not have transmission and reception means for transmitting and receiving the information signals including signals of the various data, in other words, which is capable of only transmitting operational commands and operation modes using simple ON/OFF signals (hereinafter referred to operational signals), includes operational signal output means 8 for transmitting the operational signals to the operational signal input means 3 of the outdoor unit 1.

More specifically, the outdoor unit transmission and reception means 2 of the outdoor unit 1 is capable of transmitting and receiving the information signals including signals of operational commands, operational modes and various data, such as temperature data, to and from the first indoor unit 5. The operational signal input means 3 is capable of receiving operational signals sent from the second indoor unit 7.

The transmission and reception determining means 4*a* is capable of determining whether an indoor unit has transmission means for transmitting and receiving the information signals by determining whether the outdoor unit transmission and reception means 2 is transmitting and receiving the information signals.

The operation controlling means 4 is capable of controlling the operation of the devices (compressor, blower of heat exchanger, four-way valve, and expansion valve, etc.) disposed inside the outdoor unit 1 based on the results of the transmission and reception determining means 4*a* by selecting either indoor-outdoor communication control based on the information signals transmitted and received to and from the outdoor unit transmission and reception means 2 or outdoor independent control based on the operational signals from the operational signal input means 3. The first indoor unit 5 and the second indoor unit 7 are connected to the outdoor unit 1 via transmission lines.

The refrigerant circuit, as illustrated in FIG. 2, is composed by connecting an indoor unit heat exchanger 9 having a blower, a four-way valve 10, a liquid holder 11, a compressor 12, an outdoor unit heat exchanger 13 having a blower, and an expansion valve 14 in a loop via refrigerant pipes.

The method for controlling the outdoor unit of the air conditioner according to this embodiment will now be described based on FIG. 4 by referring to FIGS. 1 to 3. When the first indoor unit 5 is connected to the outdoor unit 1, information signals including operational commands and various data such as temperature data are transmitted and received between the indoor unit transmission and reception means 6 inside the first indoor unit 5 and the outdoor unit transmission and reception means 2 inside the outdoor unit 1 as seen in a known air conditioner. Based on the transmitted and received information signals, the operation controlling means 4 inside the outdoor unit 1 controls the four-way valve 10, compressor 12, the blower of the heat exchanger 13, and the expansion valve 14 disposed inside the outdoor unit 1.

When the second indoor unit 7 is connected to the outdoor unit 1, operational signals sent from the operational signal output means 8 inside the second indoor unit 7 are received by the operational signal input means 3 in the outdoor unit 1. Based on the operational signals sent unidirectionally from the second indoor unit 7, the operation controlling means 4 in the outdoor unit 1 independently controls the four-way valve 10, the compressor 12, the blower of the heat exchanger 13, and the expansion valve 14 disposed inside the outdoor unit 1.

According to this embodiment, the operational signal input means 3 is provided in the outdoor unit 1, in addition to the outdoor unit transmission and reception means 2, to enable reception of operational signals different from the information signals transmitted and received between the outdoor unit and the indoor unit, as seen in a known conditioner. Therefore, the four-way valve 10, the compressor 12, the blower of the heat exchanger 13, and the expansion valve 14 disposed inside the outdoor unit 1 can be controlled according to the reception of the operational signals. Thus, the indoor unit 7 can be connected to and used with the outdoor unit 1, provided that the indoor unit 7 has a function to transmit the operational signals of operational commands and operational modes using simple ON/OFF signals, instead of the function to transmit and receive the information signals. Further, the indoor unit 7, which is capable of transmitting the operational signals of operational commands and operational modes using simple ON/OFF signals, can be used in combination with the indoor unit 5, which is capable of transmitting and receiving the information signals including signals of various data, such as temperature data. In such a case, priority is given to the indoor-outdoor communication control based on the information signals transmitted and received by the outdoor unit transmission and reception means 2 of the outdoor unit 1.

| Reference Numerals | |
|---|---|
| 1: | outdoor unit |
| 2: | outdoor unit transmission and reception means |
| 3: | operational signal input means |
| 4: | operation controlling means |
| 4a: | transmission and reception determining means |
| 5: | indoor unit (first indoor unit) |
| 6: | indoor unit transmission and reception means |
| 7: | indoor unit (second indoor unit) |
| 8: | operational signal output means |
| 9: | indoor unit heat exchanger |
| 10: | four-way valve |
| 11: | liquid holder |
| 12: | compressor |
| 13: | outdoor unit heat exchanger |
| 14: | expansion valve |

What is claimed is:

1. A method for controlling an outdoor unit of an air conditioner, comprising the steps of:

determining whether information signals including signals of operational commands, operation modes and data are being transmitted and received to and from an indoor unit, or whether operational signals of the operational commands and the operation modes using simple ON/OFF signals are being received from an indoor unit; and selecting, based on the determined results, to control devices included in the outdoor unit, either under an indoor-outdoor communication control based on the transmitted and received information signals, or under an independent control based on the received operational signals.

2. A controller for an outdoor unit of an air conditioner, comprising:

outdoor unit transmission and reception means for transmitting and receiving information signals including signals of operational commands, operation modes and data to and from a first indoor unit, the first indoor unit being capable of transmitting and receiving the information signals;

operational signal input means for receiving operation signals of an the operational commands and the operation modes using only ON/OFF signals from a second indoor unit, the second indoor unit being capable of transmitting the operation signals;

transmission and reception determining means for determining whether the outdoor unit transmission and reception means is transmitting and receiving the information signals; and operation controlling means for selecting, based on the determined results, to control devices included in the outdoor unit, either under an indoor-outdoor communication control based on the transmitted and received information signals, or under an independent control based on the received operational signals.

* * * * *